US007470162B2

(12) United States Patent
Miyashita et al.

(10) Patent No.: US 7,470,162 B2
(45) Date of Patent: Dec. 30, 2008

(54) SHIFT SYSTEM FOR OUTBOARD MOTORS

(75) Inventors: Yasushi Miyashita, Hamamatsu (JP); Hideo Koyama, Hamamatsu (JP); Hiromichi Takewaki, Hamamatsu (JP)

(73) Assignee: Suzuki Motor Corporation, Hamamatsu-shi (JP)

( * ) Notice: Subject to any disclaimer, the term of this patent is extended or adjusted under 35 U.S.C. 154(b) by 64 days.

(21) Appl. No.: 11/788,951

(22) Filed: Apr. 23, 2007

(65) Prior Publication Data

US 2007/0254540 A1 Nov. 1, 2007

(30) Foreign Application Priority Data

Apr. 28, 2006 (JP) ..... 2006-125691

(51) Int. Cl.
*B63H 21/21* (2006.01)
*B63H 20/14* (2006.01)

(52) U.S. Cl. ..... 440/86; 440/75

(58) Field of Classification Search ..... 440/86
See application file for complete search history.

(56) References Cited

U.S. PATENT DOCUMENTS 6,905,382 B2 * 6/2005 Ochiai et al. ..... 440/86
2005/0014427 A1 * 1/2005 Yoda et al. ..... 440/86

FOREIGN PATENT DOCUMENTS

JP 2004-244003 A 9/2004
JP 2004-245350 A 9/2004

* cited by examiner

*Primary Examiner*—Jesús D Sotelo
(74) *Attorney, Agent, or Firm*—Frishauf, Holtz, Goodman & Chick, P.C.

(57) ABSTRACT

A shift system for outboard motors, which is reduced in size, and is capable securing compatibility with an outboard motor of a type for which the shift operation is manually performed using a shift cable. A motor-driven shift actuator is disposed at a location forward of and to the right of an engine within an engine cover covering the engine. A clutch motor is provided for the actuator and disposed at a location rearward thereof, with a motor output shaft disposed in a manner extending forward, and is operated in response to the detected vessel operator's shift. An actuator output shaft is disposed at a location forward of the clutch motor and extends downward from a front part of the actuator. The actuator output shaft rotates in accordance with rotation of the motor output shaft. A clutch shaft is disposed below the actuator and rearward of the actuator output shaft. A first linkage is disposed on the right side of the actuator, as viewed in plan view, and connects between the actuator output shaft and the clutch shaft.

5 Claims, 18 Drawing Sheets

SHIFT SYSTEM FOR OUTBOARD MOTORS

BACKGROUND OF THE INVENTION

1. Field of the Invention

The present invention relates to a shift system for outboard motors, which is configured to detect a vessel operator's shift operation and operate a motor-driven shift actuator in response to the detected vessel operator's shift operation, to thereby perform a shift operation for the outboard motor in a motor-driven manner.

2. Description of the Related Art

Conventionally, there have been proposed shift systems for outboard motors, which include a motor-driven shift actuator, and are configured to detect a vessel operator's shift operation and operate the motor-driven shift actuator in response to the detected vessel operator's operation, for performing a shift operation in a motor-driven manner (see e.g. Japanese Laid-Open Patent Publications (Kokai) No. 2004-245350 and No. 2004-244003). In the shift system disclosed in Japanese Laid-Open Patent Publication (Kokai) No. 2004-245350, a motor-driven actuator is provided with a manually operable emergency gear, for failsafe function in case of failure of the motor-driven actuator fails.

However, in the shift system disclosed in Japanese Laid-Open Patent Publication (Kokai) No. 2004-245350, the motor-driven actuator is connected to a shift rod via a plurality of reduction gears and shift rod-side gears and the like, and hence it is difficult for the shift system be compatible with a conventional outboard motor of a type for which the shift operation is manually performed using a shift cable.

On the other hand, the shift system disclosed in Japanese Laid-Open Patent Publication (Kokai) No. 2004-244003 is designed without giving sufficient consideration to the orientation of a motor output shaft or the disposition of a motor-driven shift actuator, for compactness thereof, which results in an increase in the size of the whole shift system. Further, the shift system has a position sensor projecting upward in an upper part thereof, which increases the vertical dimension of the system. Furthermore, a neutral switch is incorporated in the motor-driven shift actuator, which increases the size of the motor-driven shift actuator.

SUMMARY OF THE INVENTION

The present invention provides a shift system for outboard motors, which is reduced in size, and is capable of securing compatibility with an outboard motor of a type for which the shift operation is manually performed using a shift cable.

The present invention provides a shift system for an outboard motor, which detects a vessel operator's shift operation and performs a shift operation for the outboard motor in a motor-driven manner in response to the detected vessel operator's shift operation, comprising a motor-driven shift actuator disposed at a location forward of and lateral to an engine within an engine cover covering the engine, an electric motor provided for the motor-driven shift actuator and disposed at a location rearward of the motor-driven shift actuator, the electric motor having a motor output shaft disposed in a manner extending forward, and being operated in response to the detected vessel operator's shift operation, an actuator output shaft disposed at a location forward of the electric motor and extending downward from a front part of the motor-driven shift actuator, and rotating in accordance with rotation of the motor output shaft, a clutch shaft disposed below the motor-driven shift actuator and rearward of the actuator output shaft, and a first linkage disposed on a side of the motor-driven shift actuator, as viewed in plan view, and connecting between the actuator output shaft and the clutch shaft.

With this arrangement, it is possible to reduce the size of the system and secure compatibility with an outboard motor of a type for which the shift operation is manually performed using a shift cable.

The motor-driven shift actuator can be mounted on an upper side of a base member secured to the outboard motor, the clutch shaft extending downward from the base member, and a neutral switch can be disposed under the base member and beside the clutch shaft.

With this arrangement, it is possible to maintain the shift system compact in size in spite of the presence of the neural switch.

The motor-driven shift actuator can be mounted on an upper side of a base member secure to the outboard motor, the clutch shaft extending downward from the base member, and a position sensor can be disposed on the upper side of the base member and below the electric motor, for detecting a rotational angle of the clutch shaft.

With this arrangement, it is possible to maintain the shift system compact in size in spite of the presence of the position sensor.

The shift system can further comprise a clutch rod connected to a clutch mechanism within a gear case of the outboard motor, and a second linkage connecting between the clutch shaft and the clutch rod, and a damper can be provided on at least one portion of the first linkage, the second linkage, and an upper end of the clutch rod.

With this arrangement, it is possible to provide a high damping effect with the compact arrangement.

The engine cover can be vertically divided at a dividing face, and the motor-driven shift actuator can be disposed above the dividing face while the first linkage can be disposed below the dividing face.

With this arrangement, it is possible to ensure excellent operability in switching to the shift operation using a shift cable.

The above and other objects, features, and advantages of the invention will become more apparent from the following detailed description taken in conjunction with the accompanying drawings.

BRIEF DESCRIPTION OF THE DRAWINGS

FIGS. 16A and 16B are views showing a first example of disposition of a position sensor in a shift system according to a third embodiment, in which FIG. 16A is a bottom view of a right front part of an engine holder, which corresponds to FIG. 4, and FIG. 16B is a cross-sectional view of the upper front part of the engine holder;

DETAILED DESCRIPTION OF THE PREFERRED EMBODIMENTS

The present invention will now be described in detail below with reference to the drawings showing preferred embodiments thereof.

Figure 1:
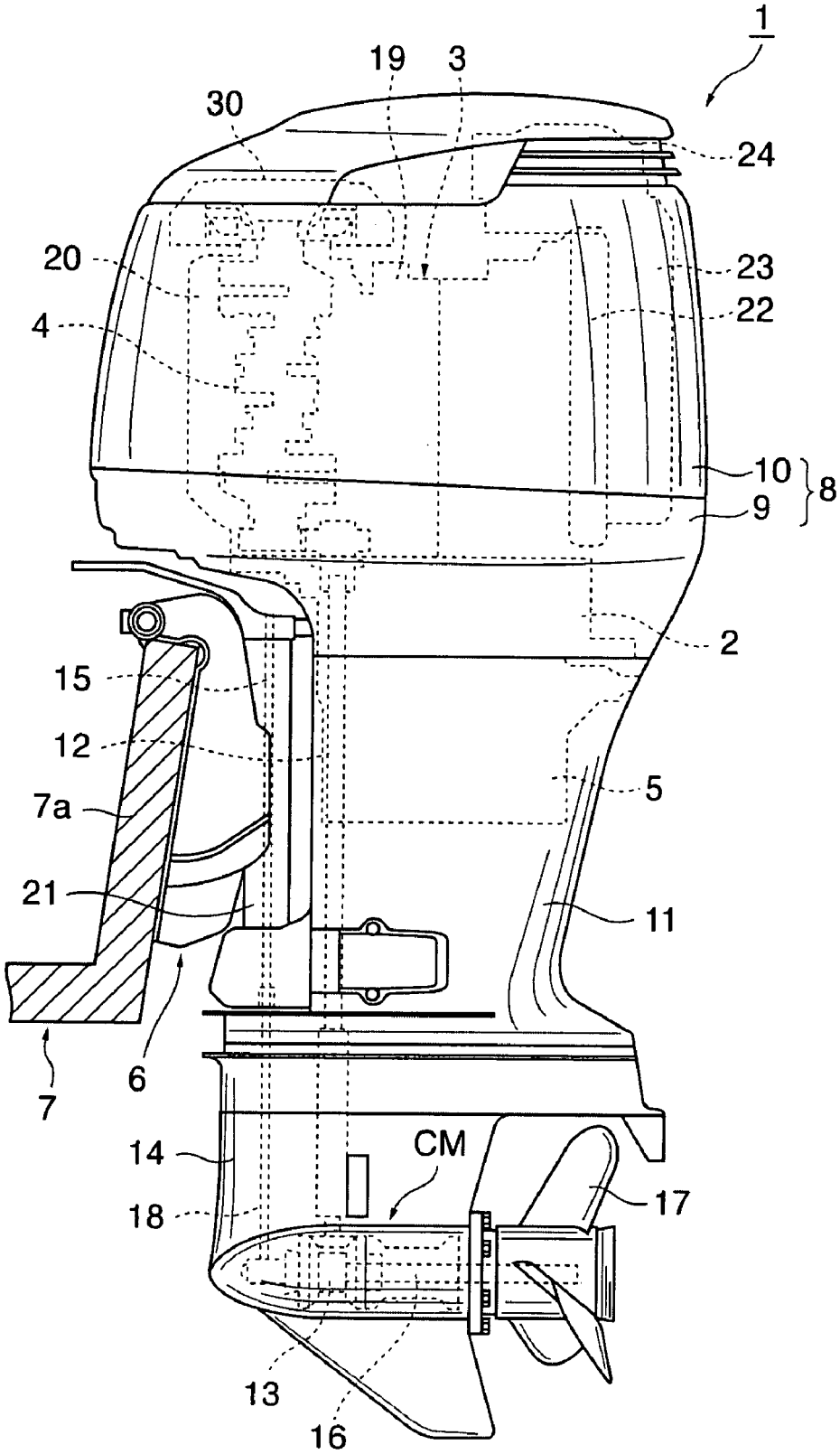
FIG. 1 is a left side view of an outboard motor to which is applied a shift system according to a first embodiment of the present invention.

FIG. 1 is a left side view of an outboard motor to which is applied a shift system according to a first embodiment of the present invention.

The outboard motor 1 includes an engine holder 2, and an engine 3 installed on the engine holder 2. The engine 3 is a vertical-type water-cooled four-cycle six-cylinder engine having a crankshaft 4 substantially perpendicularly installed therein.

Under the engine holder 2, there is disposed an oil pan 5 for storing lubricating oil. The outboard motor 1 has a bracket device 6 attached thereto, and is mounted to a transom 7*a* of a vessel 7 via the bracket device 6. Hereafter, the ship side of the outboard motor 1 will be referred to as "the front", and a side toward the viewer, as viewed in FIG. 1, as "the left". Further, the sides in the vertical direction will be referred to with reference to a tilt-down state (state shown in FIG. 1) of the outboard motor 1.

An engine cover 8 covers around the engine 3, the engine holder 2, and the oil pan 5. The engine cover 8 is comprised of a lower engine cover 9 that covers the lower half of the engine 3 from the sides, and an upper engine cover 10 that covers the upper half of the engine 3 in a manner capped on the lower engine cover 9. The lower engine cover 9 is secured e.g. to the engine holder 2, while the upper engine cover 10 is removably attached to the lower engine cover 9.

A driveshaft housing 11 is disposed in a manner covering around and below the oil pan 5. A driveshaft 12 is substantially vertically disposed and extends through the engine holder 2, the oil pan 5, and the driveshaft housing 11. Within a gear case 14 disposed below the driveshaft housing 11, there is arranged a clutch mechanism CM. The driveshaft 12 extends downward through the driveshaft housing 11 to drive a propeller 17 as a propulsion device via the clutch mechanism CM, a propeller shaft 16, and so forth.

The clutch mechanism CM has a shift rod 18 connected thereto. A steering shaft 21 is vertically and pivotally journaled in a swivel bracket provided in the bracket device 6. The steering shaft 21 is formed to be hollow, and has a clutch rod 15 inserted therethrough. The clutch rod 15 extends downward from a location close to the engine 3 and is connected to the shift rod 18 at a location near a joint between the driveshaft housing 11 and the gear case 14. The shift rod 18 is operated by rotation of the clutch rod 15 to drive a clutch dog 13, whereby the shift operation is performed for switching the rotation of the propeller shaft 16 between normal rotation and reverse rotation.

Figure 2:
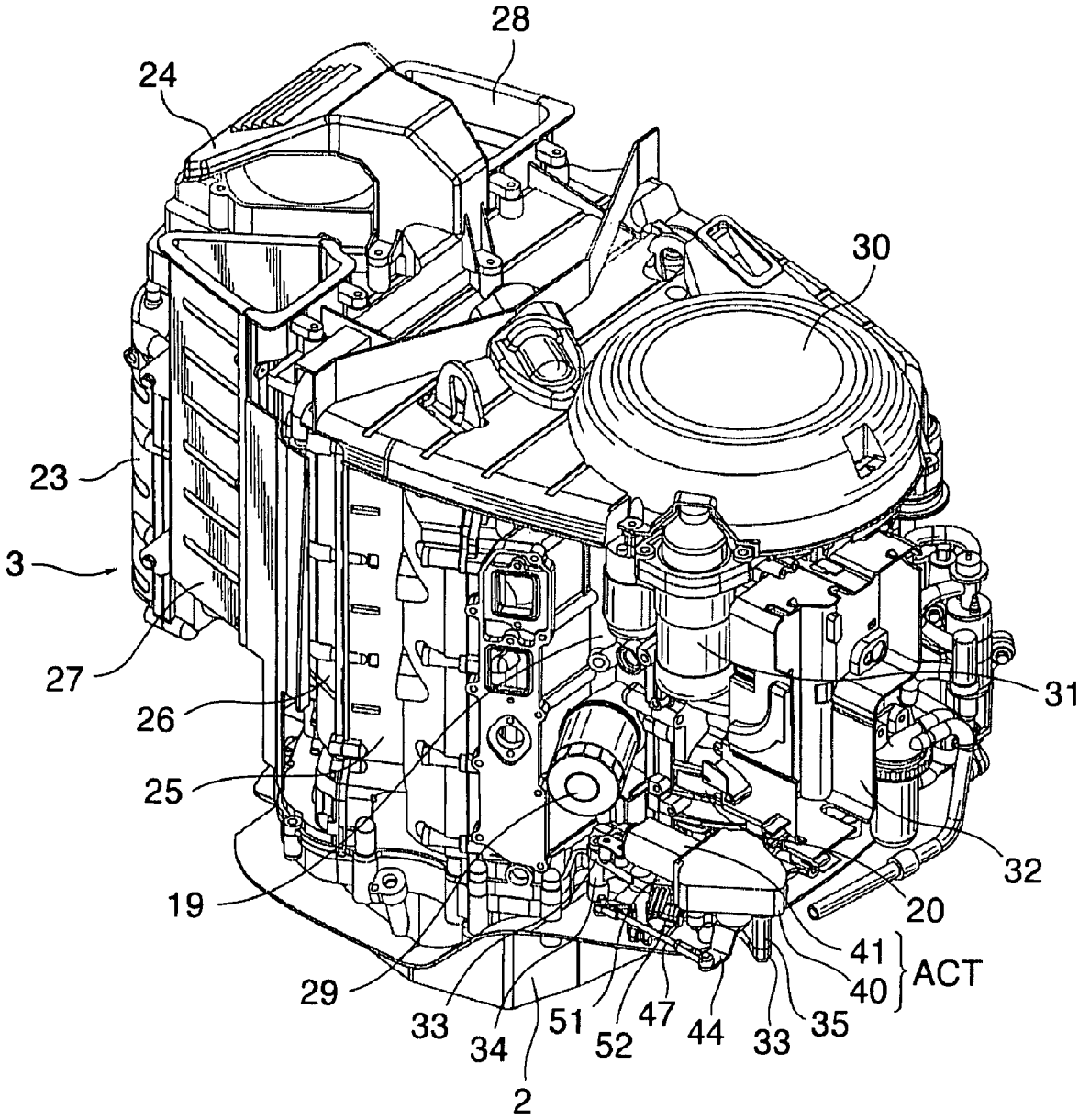
FIG. 2 is a perspective view of an engine and component parts associated therewith.
Figure 3:
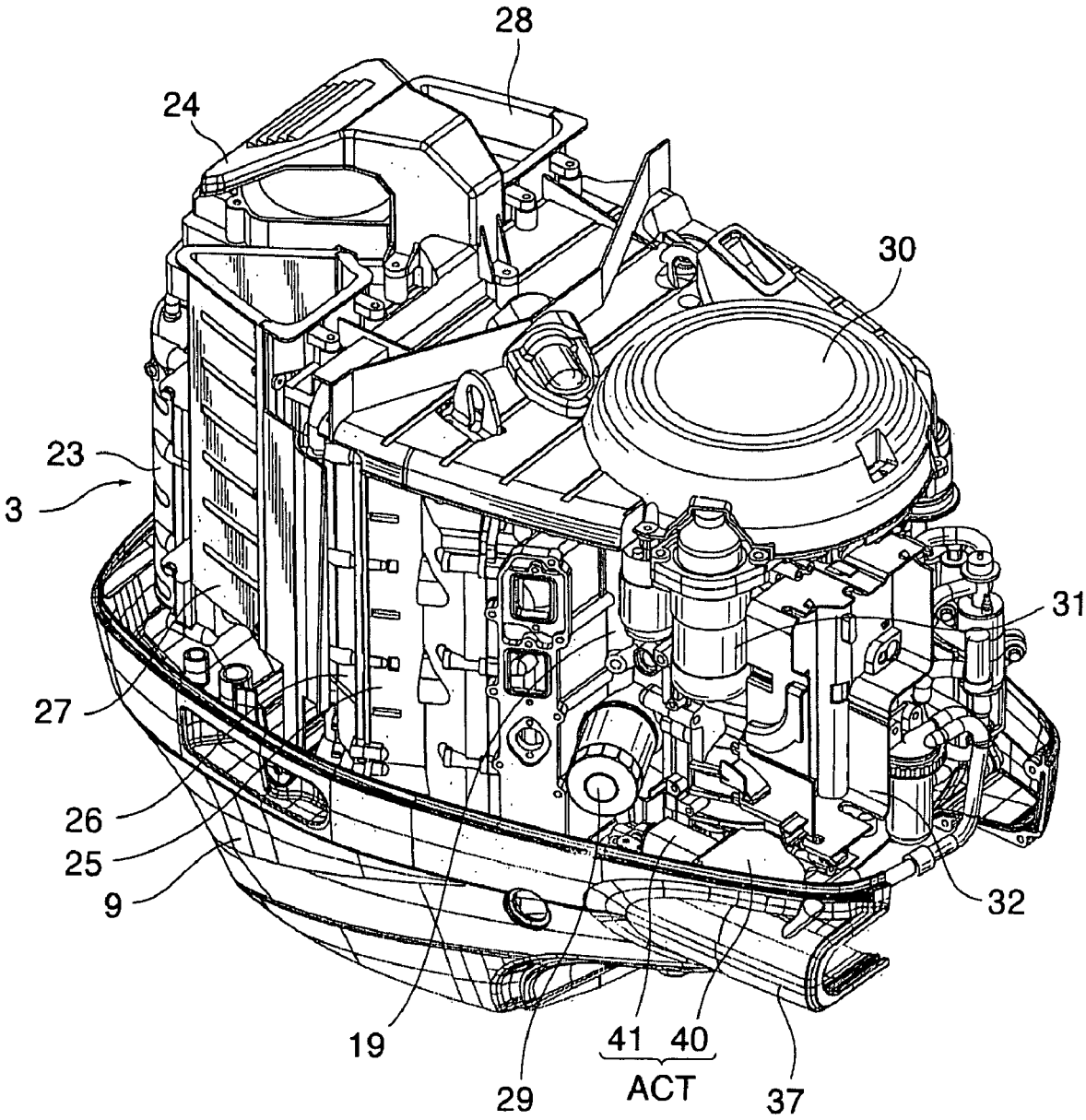
FIG. 3 is a perspective view of the engine and the component parts associated therewith, with a lower engine cover mounted thereon.

FIG. 2 is a perspective view of the engine 3 and component parts associated therewith. FIG. 3 is a perspective view of the engine 3 and the component parts associated therewith, with the lower engine cover 9 mounted thereon.

As shown in FIGS. 1 to 3, a crankcase 20 is disposed in the front of the engine 3, and a cylinder block 19 is disposed rearward of the crankcase 20. The crankshaft 4 (see FIG. 1) is journaled in joined surfaces of the crankcase 20 and the cylinder block 19. The cylinder block 19 has left and right bank portions disposed in a V-shaped arrangement in plan view to form a rearwardly open V-bank. As shown in FIGS. 2 and 3, a pair of left and right cylinder heads 25 are provided in a manner associated with the respective left and right bank portions, and a cylinder head cover 26 is provided on the rear part of each cylinder head 25 in a manner covering the same.

As shown in FIG. 1, at a location rearward of the central part of the engine 3, there is provided an intake system comprised of an intake manifold 22 and a surge tank 23. Further, a silencer 24 is connected to an upstream side of the surge tank 23. As shown in FIGS. 2 and 3, on the left and right sides of the rear part of the engine 3, there are provided left and right air intake ducts 28 and 27, respectively.

On the top of the crankshaft 4 (see FIG. 1), there is mounted a flywheel magnet cover 30 for covering a magnet device, not shown. An oil filter 29 is disposed on the right side of the cylinder block 19. Further, at a location rightward of the crankcase 20, there is disposed a starter motor 31, and at a location forward of the crankcase 20, there is disposed an electrical component box 32.

As shown in FIGS. 2 and 3, within the lower engine cover 9, a motor-driven actuator ACT for a shift operation (hereinafter simply referred to as "the actuator ACT") is disposed at a location forward of the engine 3 at the right side. The actuator ACT is comprised of an actuator body 40 and a clutch motor (hereinafter simply referred to as "the motor") 41, and is located close to a rigging port 37 (see FIG. 3). A mechanism extending from the actuator ACT to the clutch mechanism CM constitutes the shift system according to the present invention.

Figure 4:
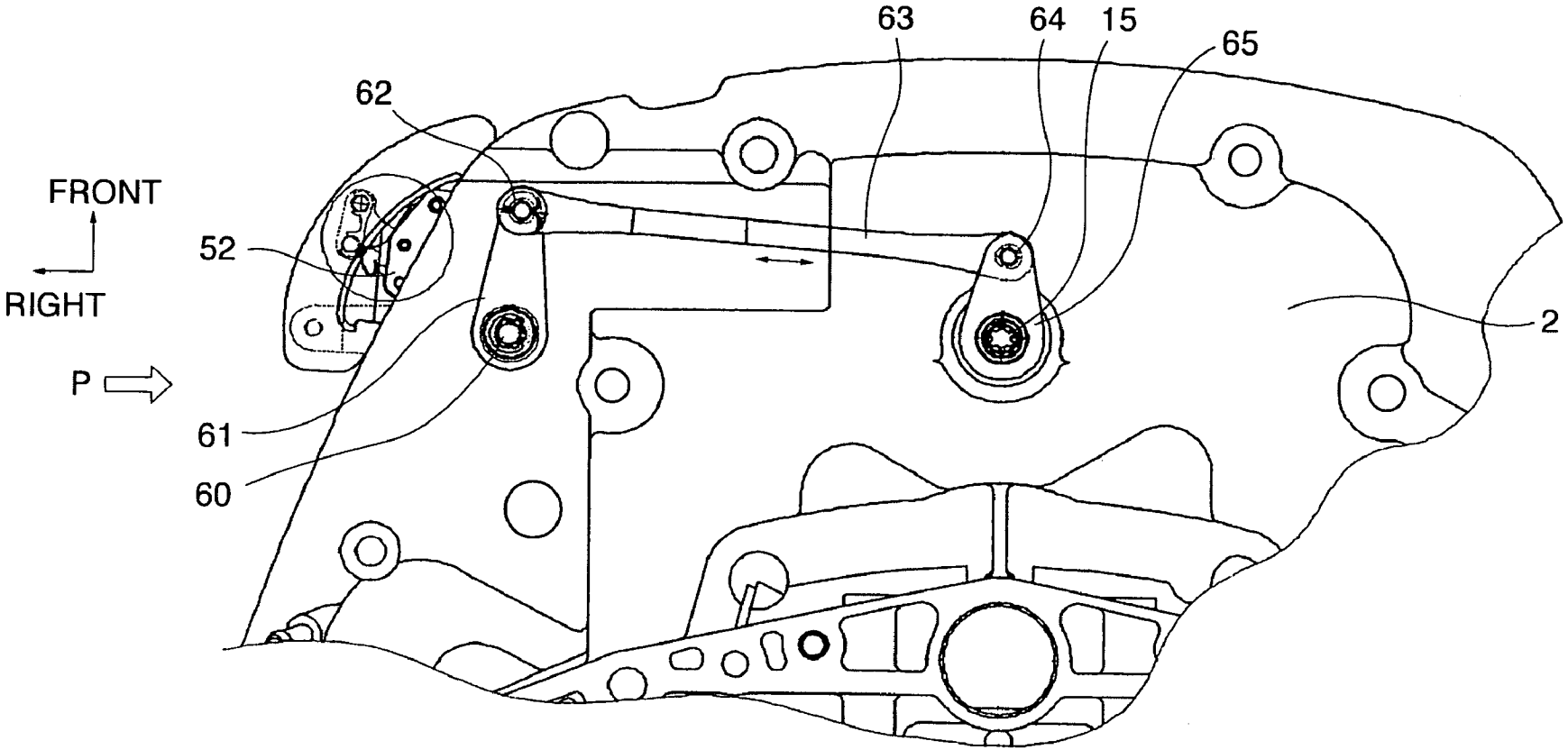
FIG. 4 is a bottom view of a right front part of an engine holder.
Figure 5:
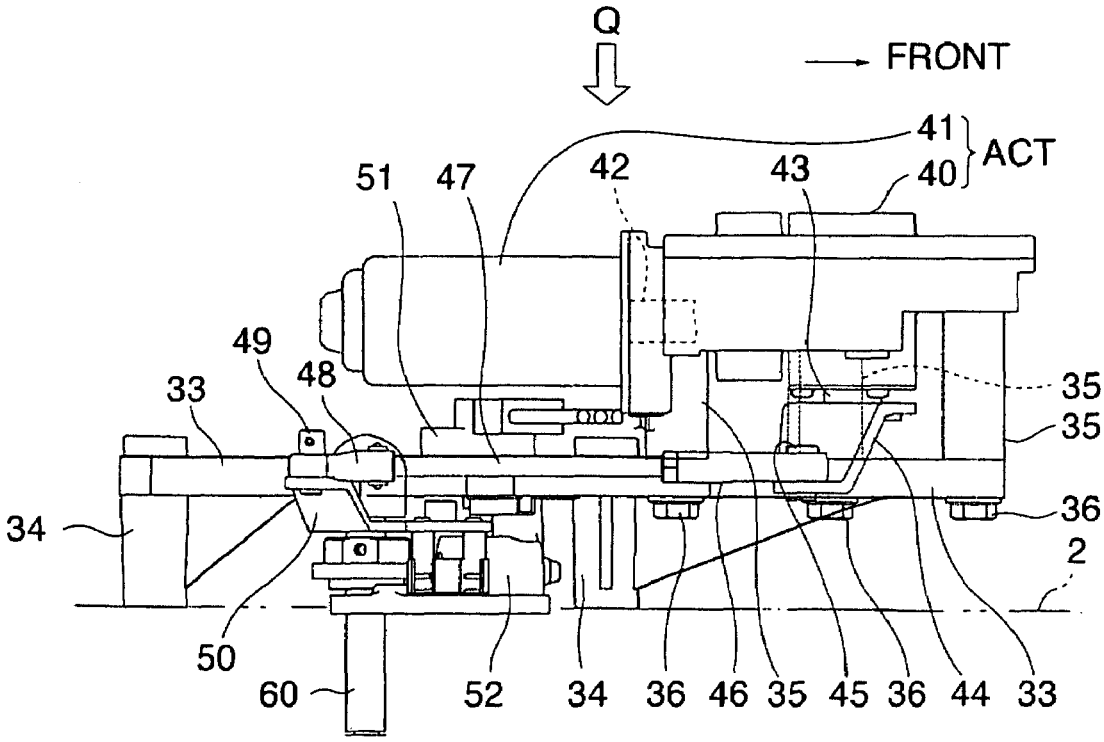
FIG. 5 is a right side view as viewed in a direction indicated by an arrow P in FIG. 4.
Figure 6:
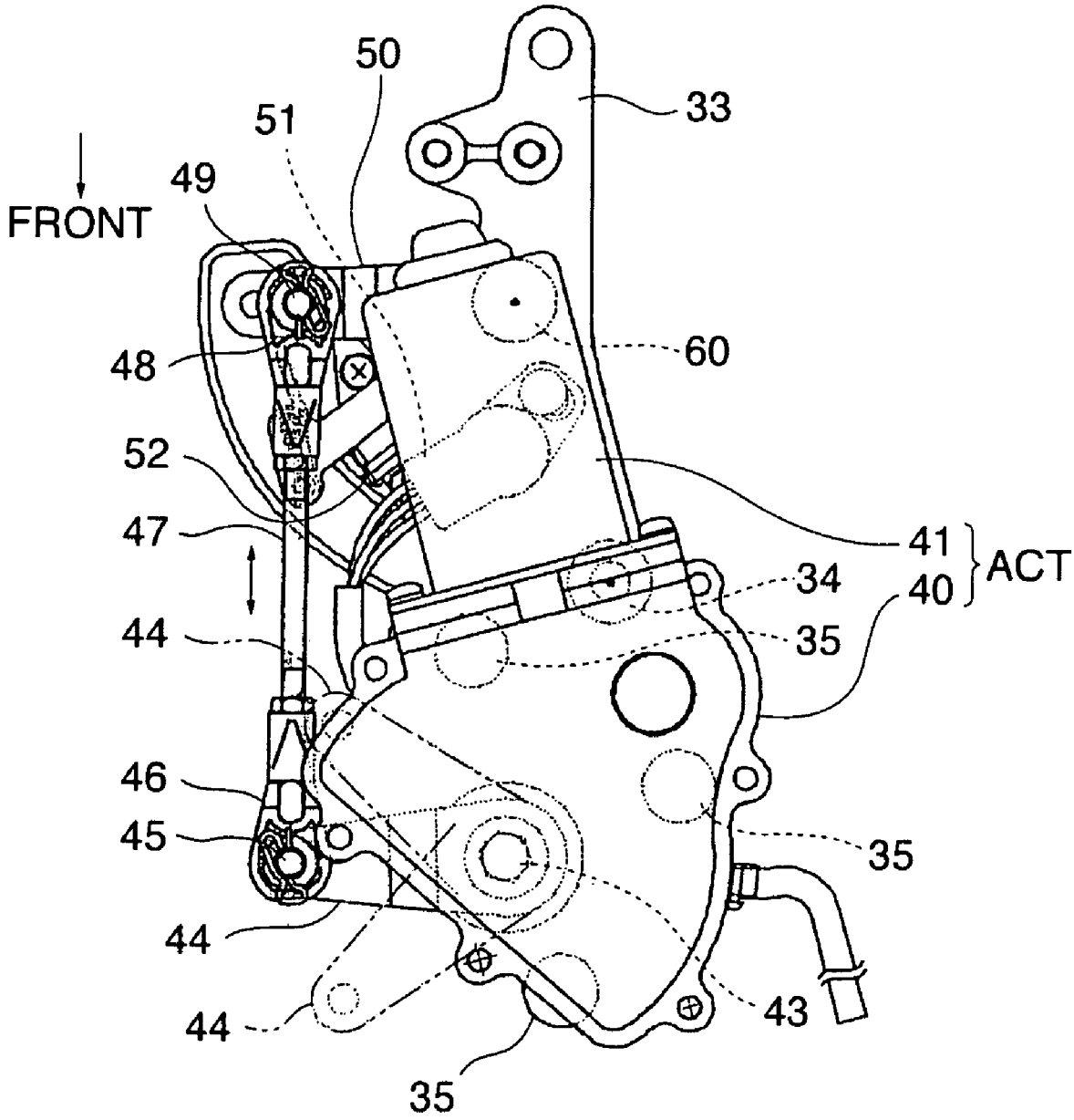
FIG. 6 is a plan view as viewed in a direction indicated by an arrow Q in FIG. 5.

FIG. 4 is a bottom view of the right front part of the engine holder 2. FIG. 5 is a right side view as viewed in a direction indicated by an arrow P in FIG. 4, and FIG. 6 is a plan view as viewed in a direction indicated by an arrow Q in FIG. 5.

The actuator ACT has the actuator body 40 as a front half thereof and the motor 41 as a rear half thereof. The motor 41 extends substantially in the longitudinal direction with its length positioned horizontally. Strictly, the motor 41 is slightly inclined left (within an angle range of 30 degrees), as it extends forward (see FIG. 6). The motor 41 is linked and fixed to the rear part of the actuator body 40. The motor 41 has a motor output shaft 42 (see FIG. 5) extending substantially forward (toward the actuator body 40). The actuator body 40 has an actuator output shaft 43 extending downward.

A clutch base 33 as a horizontal plate member is fixed to the top of the engine holder 2 via a plurality of supports 34. Further, the actuator body 40 is fixed to the top of the clutch base 33 by a plurality of bolts 36 via a plurality of supports 35 provided under the actuator body 40.

Although not shown, the vessel 7 is provided with a remote control box for use in the shift operation and a throttle operation, and the remote control box is provided with an operation-detecting section that detects a vessel operator's operation on the remote control box. A detection signal indicative of the detected vessel operator's operation on the remote control box is supplied to an ECU, not shown, provided in the electrical component box 32. As to the shift operation, a control signal generated in response to a detection signal indicative of a detected vessel operator's shift operation is supplied to the motor 41 from the ECU. The motor output shaft 42 rotates according to the control signal, and the actuator output shaft 43 rotates along with the rotation of the motor output shaft 42.

A clutch shaft 60 extends perpendicularly to the engine holder 2 in a pivotally movable manner. As shown in FIGS. 5 and 6, the clutch shaft 60 is disposed below the motor 41 and on the lower side of the clutch base 33, at a location rearward of the actuator output shaft 43. The actuator output shaft 43 and the clutch shaft 60 are arranged at approximately the same transverse location as viewed in plan view (see FIG. 6).

The actuator output shaft 43 and the clutch shaft 60 are connected by a "first linkage" that transmits rotation of the actuator output shaft 43 to the clutch shaft 60. The first linkage is comprised of an arm 44, a connecting pin 45, a connector 46, a first link member 47, a connector 48, a connecting pin 49, and an arm 50. These members are arranged at respective vertical locations between the actuator ACT and the engine holder 2, and close to the right side of the actuator ACT as viewed in plan view.

One end of the arm 44 is connected to the lower end of the actuator output shaft 43 such that the arm 44 is rotatable in unison with the actuator output shaft 43, and the other end of the arm 44 and the connector 46 are pivotally connected to each other via the connecting pin 45 as a pivot. The first link member 47 horizontally extends in the longitudinal direction, with the connector 46 attached to a front end thereof, and the connector 48 attached to a rear end thereof. The first link member 47 is formed to be compact in size so that the length of the first link member 47 including the connectors 46 and 48 is within that of the actuator ACT in the longitudinal direction. The connector 48 and one end of the arm 50 are pivotally connected to each other via the connecting pin 49 as a pivot. The other end of the arm 50 is connected to the upper end of the clutch shaft 60 such that the arm 50 is rotatable in unison with the clutch shaft 60.

When rotation of the motor output shaft 42 causes the actuator output shaft 43 to rotate within a predetermined range, the arm 44 rotates in accordance with the rotation of the actuator output shaft 43 whereby the other end of the arm 44 is displaced in the longitudinal direction, which causes the first link member 47 as well to move in the longitudinal direction. At the same time, the one end of the arm 50 is displaced in the longitudinal direction in accordance with the longitudinal motion of the first link member 47, whereby the arm 50 is rotated, which causes rotation of the clutch shaft 60.

On the other hand, as shown in FIG. 4, the clutch shaft 60 and the clutch rod 15 are connected to each other by a "second linkage" that transmits rotation of the clutch shaft 60 to the clutch rod 15. The second linkage is comprised of an arm 61, a connecting pin 62, a second link member 63, a connecting pin 64, and an arm 65. These members are arranged on the lower side of the front right half of the engine holder 2.

One end of the arm 61 is connected to the lower end of the clutch shaft 60 below the engine holder 2 such that the arm 61 is rotatable in unison with the clutch shaft 60, and the other end of the arm 61 is connected to the right end of the second link member 63 such that the arm 61 is pivotally movable about the connecting pin 62 a pivot. The second link member 63 extends substantially along the transverse direction. One end of the arm 65 is connected to the left end of the second link member 63 such that the arm 65 is pivotally movable about the connecting pin 64 as a pivot, and the other end of the arm 65 is connected to the upper end of the clutch rod 15 such that the arm 65 is rotatable in unison with the clutch rod 15.

The arm 61 rotates in accordance with rotation of the clutch shaft 60, causing the other end of the arm 61 to be displaced in the transverse direction, which causes the second link member 63 as well to move substantially in the transverse direction. At the same time, the one end of the arm 65 is displaced in the transverse direction in accordance with the transverse motion of the second link member 63 to rotate the arm 65, which causes rotation of the clutch rod 15. As a consequence, the clutch dog 13 (see FIG. 1) is driven via the shift rod 18. The shift operation for switching the rotation of the propeller shaft 16 between normal rotation and reverse rotation is thus realized using the actuator ACT in a motor-driven manner in response to the vessel operator's shift operation.

As shown in FIGS. 5 and 6, below the motor 41, a position sensor 51 is fixedly disposed on the clutch base 33. The position sensor 51 detects the rotational angle of the clutch shaft 60, and delivers a detection signal indicative of the detected rotational angle to the ECU, not shown. Further, below the clutch base 33, a neutral switch 52 is disposed at a location transversely close to the upper end of the clutch shaft 60. The neutral switch 52 is fixed e.g. on the engine holder 2, and when in a neutral position, delivers a neutral signal indicative of its neutral position to the ECU.

The detection signal from the position sensor 51 is used e.g. for feedback control of driving operation of the clutch dog 13, whereby driving operation by the actuator ACT is controlled such that it is responsive to the vessel operator's shift operation.

On the other hand, the signal output from the neutral switch 52 is used e.g. for determining whether or not to start the engine. For example, in the neutral-ON state (neutral position) of the neutral switch 52, the ECU provides control such that even when a throttle (not shown) is opened, the rotational speed of the engine does not become higher than a predetermined value, while in the neutral-OFF state of the same, the ECU provides control such that starting of the engine is inhibited.

It should be noted that the neutral signal may also be used for control or feedback control of the shift operation. For example, the neutral signal may be used to stop driving operation by the actuator ACT at the time of a shift from a forward (F) position to a neutral (N) position, or at the time of a shift from a reverse (R) position to the neutral (N) position.

By the way, when mounting the outboard motor 1 of the present invention in the vessel 7 in place of the conventional outboard motor of a type for which the shift operation is manually performed using a shift cable, the first link member 47 and the connectors 46 and 48 are removed to thereby disconnect the actuator ACT and the clutch shaft 60 from each other. Further, a cable holder is provided, and the shift cable is attached to the connecting pin 49. This enables the same shift operation to be performed as conventionally manually performed. That is, the present shift system is compatible with an outboard motor of a type for which the shift operation is manually performed using a shift cable.

Also when the actuator ACT accidentally fails, a failsafe function can be provided by attaching the shift cable to the connecting pin 49 similarly to the above. On the other hand, when the failsafe function is simply required, an attachment is added to the connecting pin 49 to make the arm 50 manually rotatable, whereby a manual shift operation is made possible.

It should be noted that a part to which the shift cable is attached may be any part which is capable of applying a manual rotational force to the clutch shaft 60 in place of the actuator ACT, and hence the part is not limited to the connecting pin 49. Further, in the case of switching to the shift operation using the shift cable, the actuator ACT itself may be removed.

According to the present embodiment, since the motor 41 is disposed horizontally, it is possible to reduce the vertical dimension of the mechanism extending from the actuator ACT to the clutch shaft 60 in the shift system. Further, since the actuator body 40 and the motor 41 are arranged in a line in the longitudinal direction, and the first linkage is disposed horizontally at the side of the actuator ACT, the actuator ACT and the first linkage (mainly, the first link member 47 thereof) are close to a parallel positional relationship. In particular, a line connecting between the actuator output shaft-43 and the clutch shaft 60, and the first link member 47 are parallel in plan view, and the actuator ACT and the first link member 47 are parallel in side view. This arrangement makes it possible to save more space in both the longitudinal and transverse directions than the arrangement in which the first linkage extends vertically, transversely, or obliquely. Therefore, despite the presence of the linkages, the shift system can be made small in size, which enables the essential parts of the shift system to be accommodated in a small space at a location forward of the engine 3 at the right side.

Further, since the manual shift operation can be performed by disconnecting the actuator ACT and the clutch shaft 60 from each other and connecting the shift cable or the like to the connecting pin 49 or the like, it is possible not only to secure compatibility of the shift system with an outboard motor of the conventional shift operation type, but also to secure the failsafe function in the event of failure of the actuator ACT.

According to the present embodiment, the neutral switch 52 is disposed beside the clutch shaft 60 at a location below the clutch base 33. Further, the position sensor 51 is fixedly disposed on the clutch base 33 at a location below the motor 41. Thus, the effective use of the small space is made to arrange the neutral switch 52 and the position sensor 51 in the vicinity of the actuator ACT of the shift system in a concentrated manner, which makes it possible to keep the shift system compact in size.

In addition, since located in the space vertically defined between the motor 41 and the clutch base 33, the position sensor 51 is hardly affected by water or an external force, which makes the position sensor 51 easy to protect.

It should be noted that the essential parts, such as the actuator ACT, of the shift system according to the present invention, may be disposed at a location transversely symmetrically opposite from the above exemplified location, i.e. at a location forward of the engine 3 at the left side.

Figure 7:
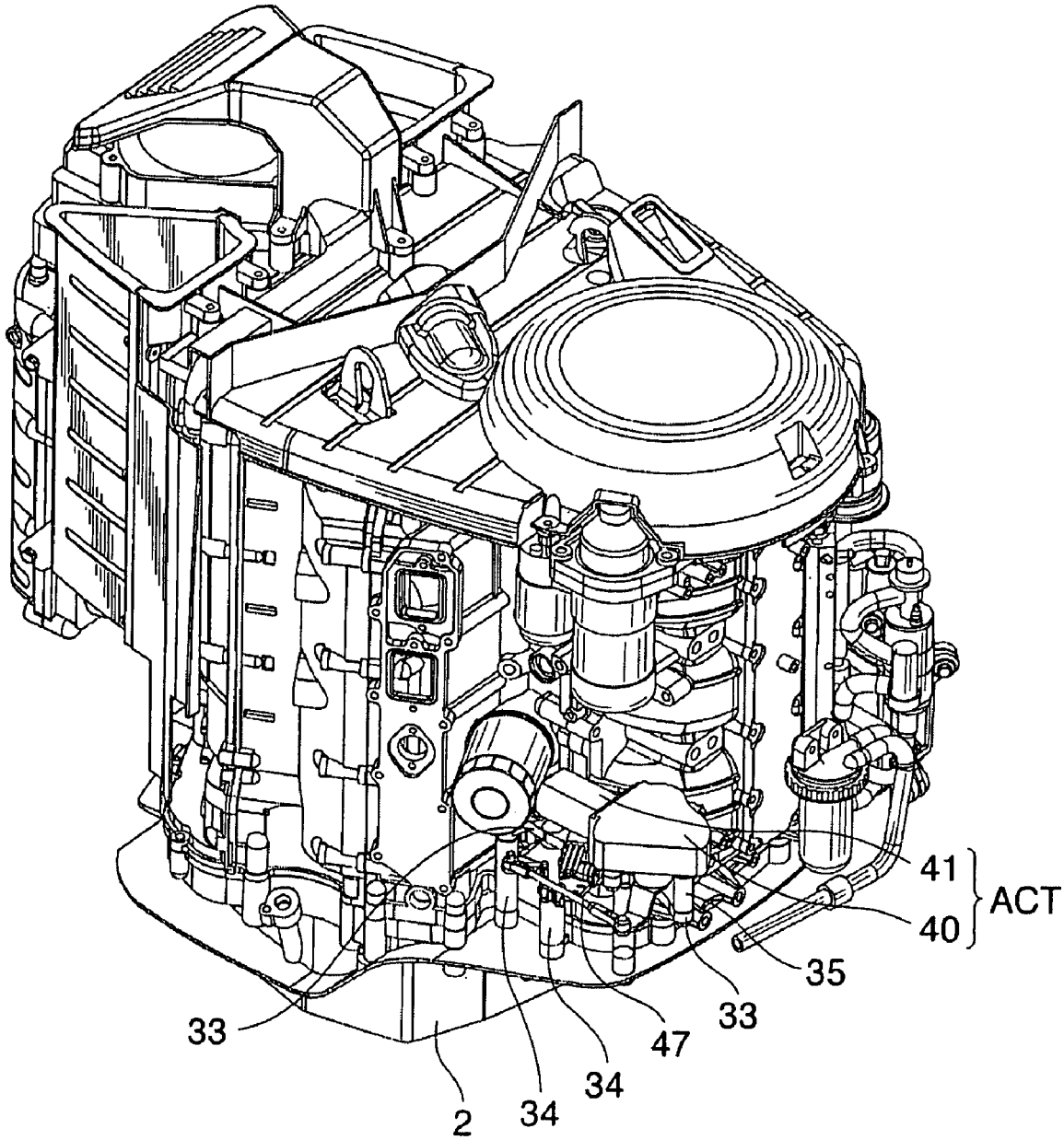
FIG. 7 is a perspective view of an engine and component parts associated therewith, according to a variation of the first embodiment.
Figure 8:
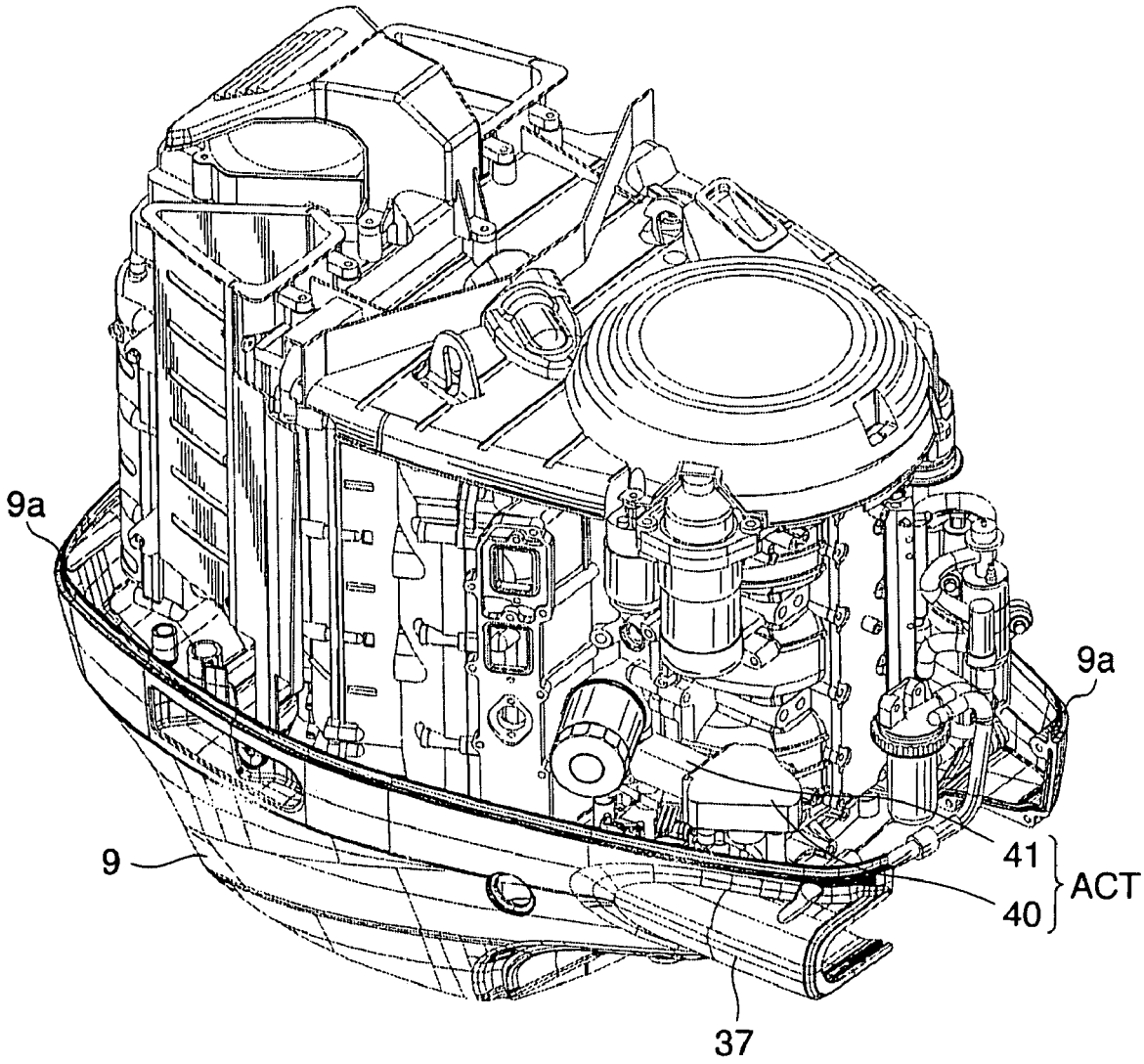
FIG. 8 is a perspective view of the engine and the component parts associated therewith, according to the variation, with a lower engine cover mounted thereon.
Figure 9:
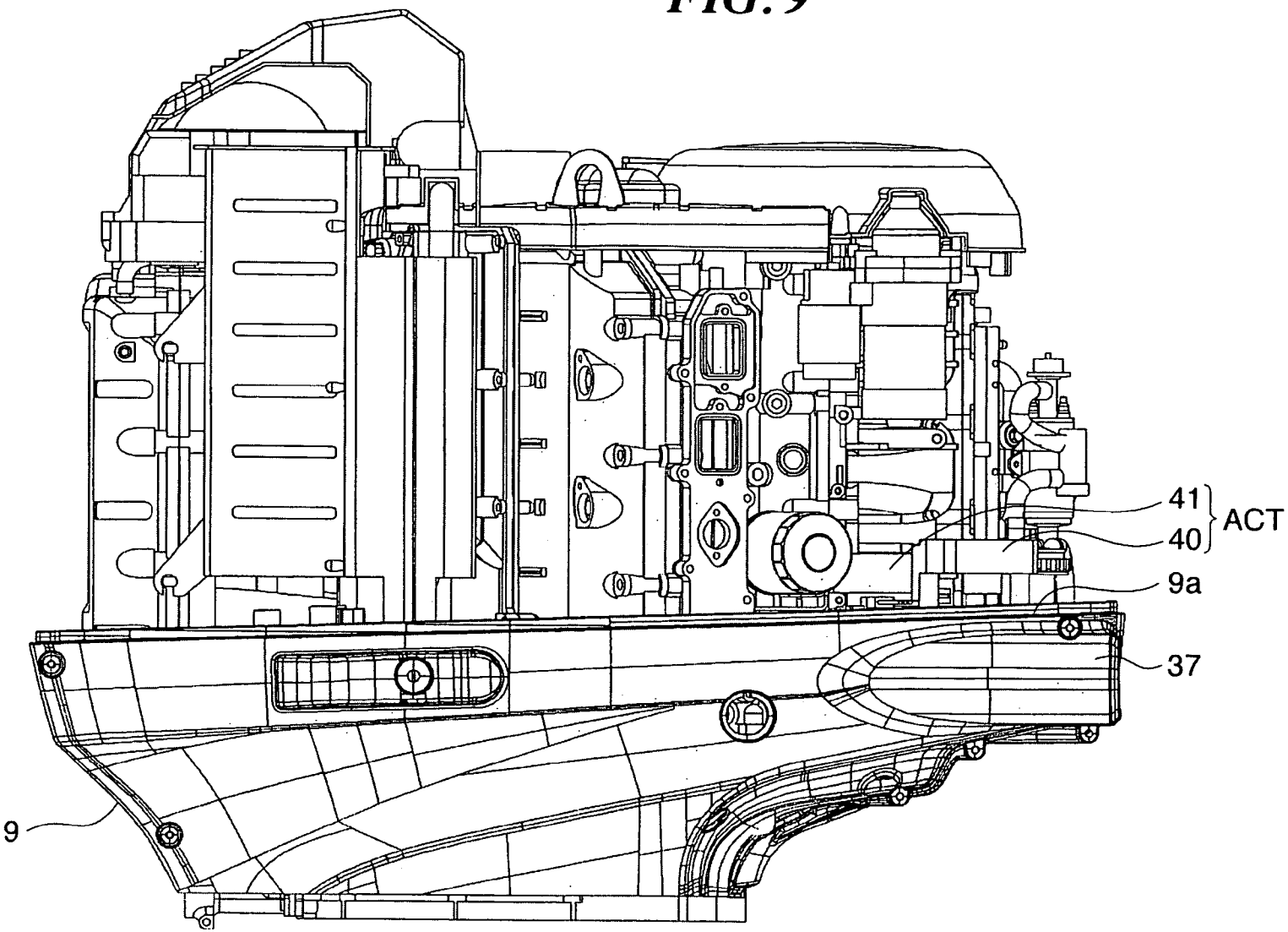
FIG. 9 is a right side view of the engine and the component parts associated therewith, according to the variation, with the lower engine cover mounted thereon.

A variation of the first embodiment, shown in FIGS. 7 to 9, is identical in arrangement to the shift system shown in FIGS. 1 to 6 except for the position of the actuator ACT.

FIG. 7 is a perspective view of the engine 3 and component parts associated therewith, according to the variation of the first embodiment. FIGS. 8 and 9 are a perspective view and a right side view of the engine 3 and the component parts associated therewith, according to the variation, with the lower engine cover 9 mounted thereto.

In this variation, the position of the clutch base 33 is made higher than in the arrangement shown in FIGS. 1 to 6, e.g. by increasing the height of the supports 34. The position of the first linkage is also increased by the increase of the height of the clutch base 33.

The upper engine cover 10 is mounted to the lower engine cover 9 by being brought into contact with a mating face 9*a* (see FIGS. 8 and 9) of the lower engine cover 9. Therefore, the engine cover 8 can be vertically divided at a dividing face corresponding to the mating face 9*a*. In this variation, since the position of the clutch base 33 is made higher as described above, the actuator ACT is located above the mating face 9*a*. The first linkage is located below the mating face 9*a*.

According to this variation, e.g. when the shift system is switched to the shift operation using the shift cable, it is possible to easily remove the actuator ACT alone by removing the upper engine cover 10. In addition, since the height of the first linkage is increased by making the supports 34 taller, it is also made easy to carry out work for attaching the shift cable to the connecting pin 49. This makes it possible to ensure excellent workability in switching to the shift operation using the shift cable.

Next, a second embodiment of the present invention will be described with reference to FIGS. 10 to 15. In the second embodiment, a damper formed e.g. of rubber is provided at an appropriate portion of the shift system between the first linkage and the upper end of the clutch rod 15 in the first embodiment. The second embodiment is identical in arrangement to the first embodiment except for the portion provided with the damper, and therefore a description will be given only of the portion provided with the damper. In FIGS. 10 to 15, component parts and elements which are identical to those of the first embodiment are designated by identical reference numerals.

Figure 10:
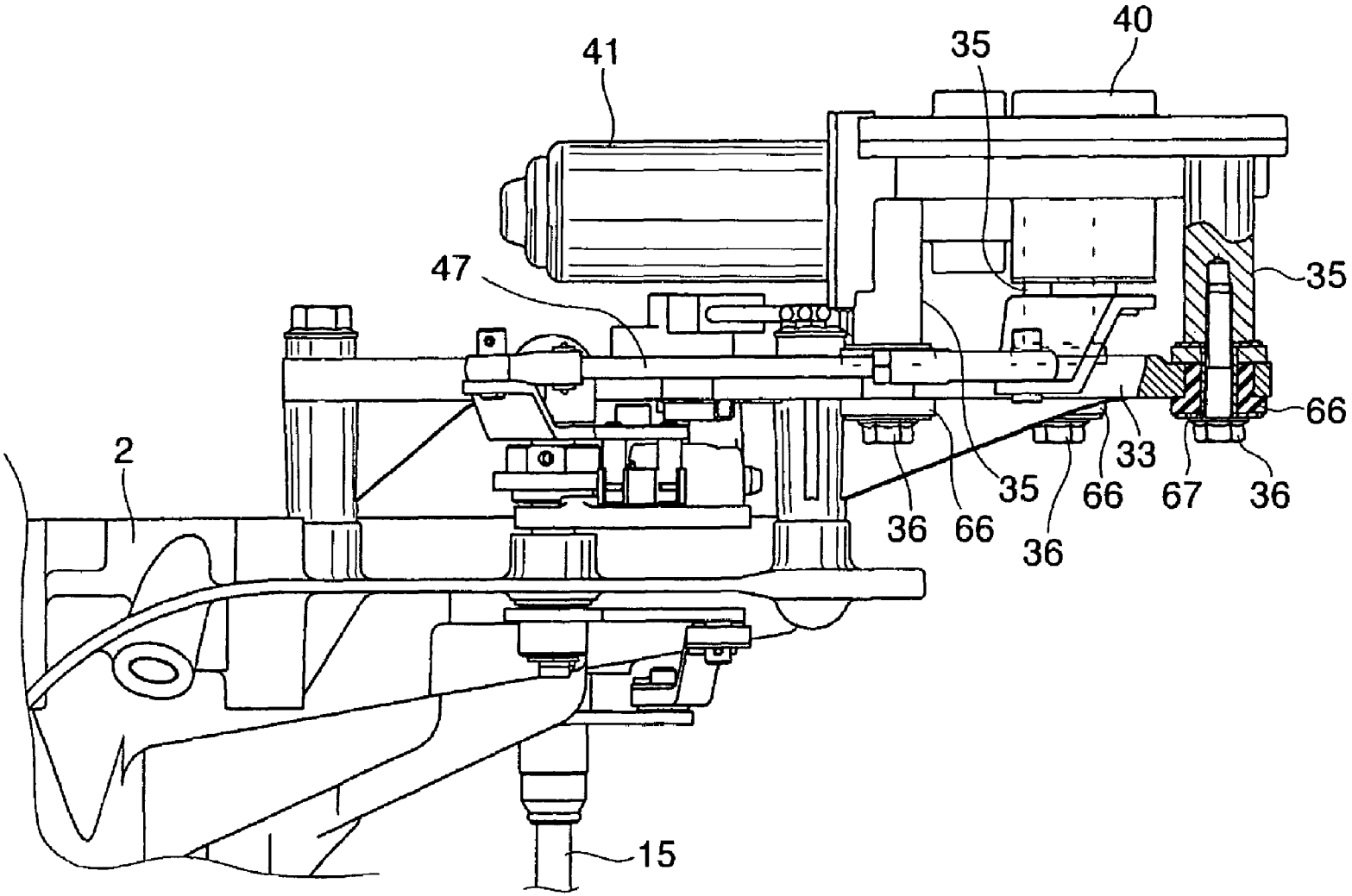
FIG. 10 is a right side view corresponding to FIG. 5 but showing a first example of application of a damper to a shift system according to a second embodiment.

FIG. 10 is a right side view corresponding to FIG. 5 but showing a first example of application of a damper to the shift system according to the second embodiment. In this example, each of the bolts 36 is screwed into an associated one of the supports 35 from below the clutch base 33 via a spacer 67 and a damper 66.

This variation makes it possible to provide a damping or cushioning function between the clutch base 33 and the actuator body 40, thereby suppressing repulsion and the like adverse effect caused by the operation of the actuator ACT.

Figure 11:
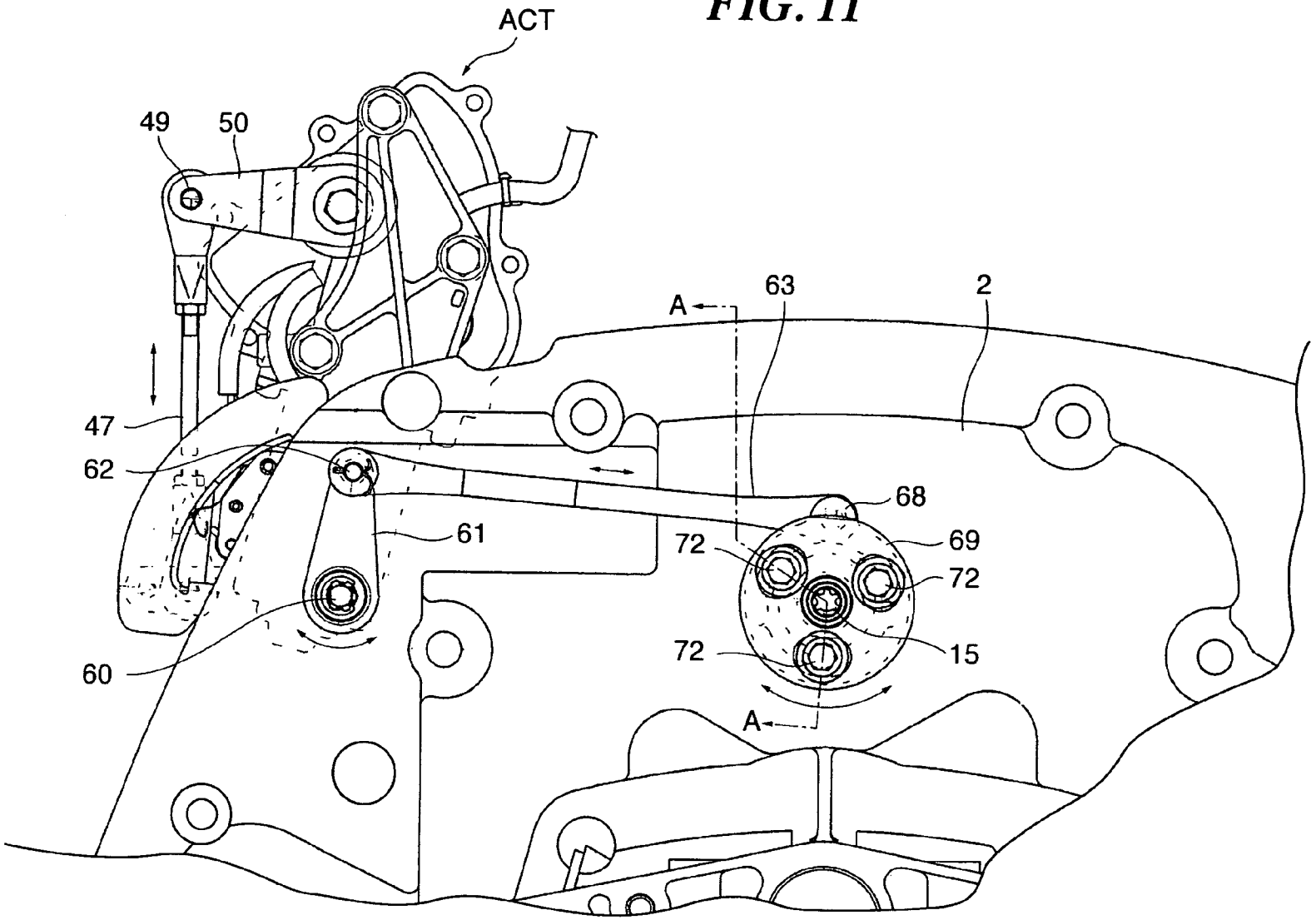
FIG. 11 is a bottom view of a right front part of an engine holder, which corresponds to FIG. 4 but shows a second example of application of a damper to the shift system according to the second embodiment.
Figure 12:
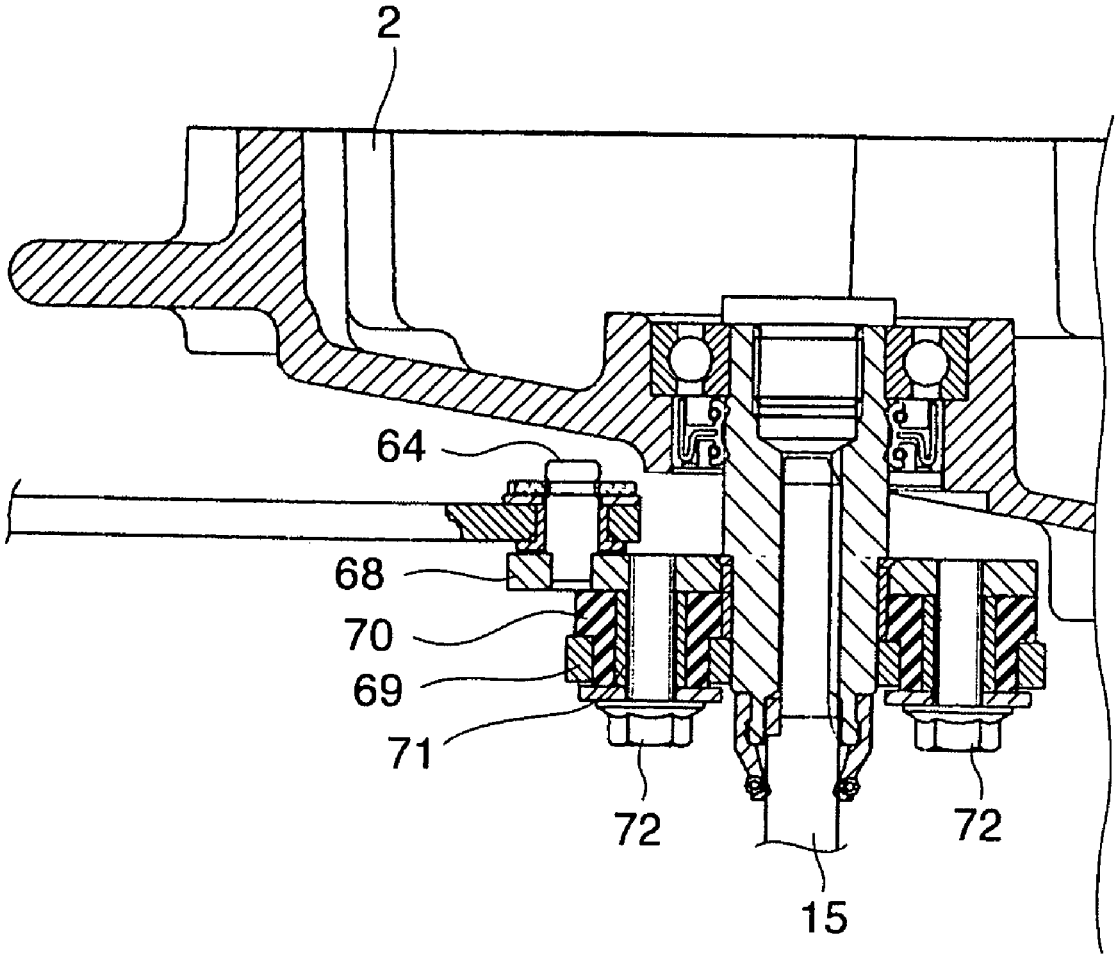
FIG. 12 is a cross-sectional view taken on line A-A of FIG. 11.

FIG. 11 is a bottom view of a right front part of an engine holder 2, which corresponds to FIG. 4 but shows a second example of application of a damper to the shift system according to the second embodiment. FIG. 12 is a cross-sectional view taken on line A-A of FIG. 11. In this example, a damper 70 is provided between the left end of the second link member 63 and the clutch rod 15.

One end of an arm 68 corresponding to the arm 65 (see FIG. 4) is connected to the left end of the second link member 63 such that the arm 68 is pivotally movable about the connecting pin 64 as a pivot. On the other hand, a plate 69 is fittedly connected to the upper end of the clutch rod 15 in a manner rotatable in unison with the clutch rod 15. Further, between the other end of the arm 68 and the plate 69, there are mounted an annular spacer 71 and the damper 70. The other end of the arm 68 and the plate 69 are fastened to each other via the annular spacer 71 and the damper 70 by screwing bolts 72 from below at a plurality of (e.g. three) locations.

This variation makes it possible to provide a damping or cushioning function in a torsional direction between the arm 68 and the clutch rod 15, thereby providing the same advantageous effects as provided in the first example of application of the damper. Besides, particularly around the upper end of the clutch rod 15, there is sufficient space for a large-sized damper 70 to be provided for making effective use of dead space, which makes it possible to provide a high damping effect.

Figure 13:
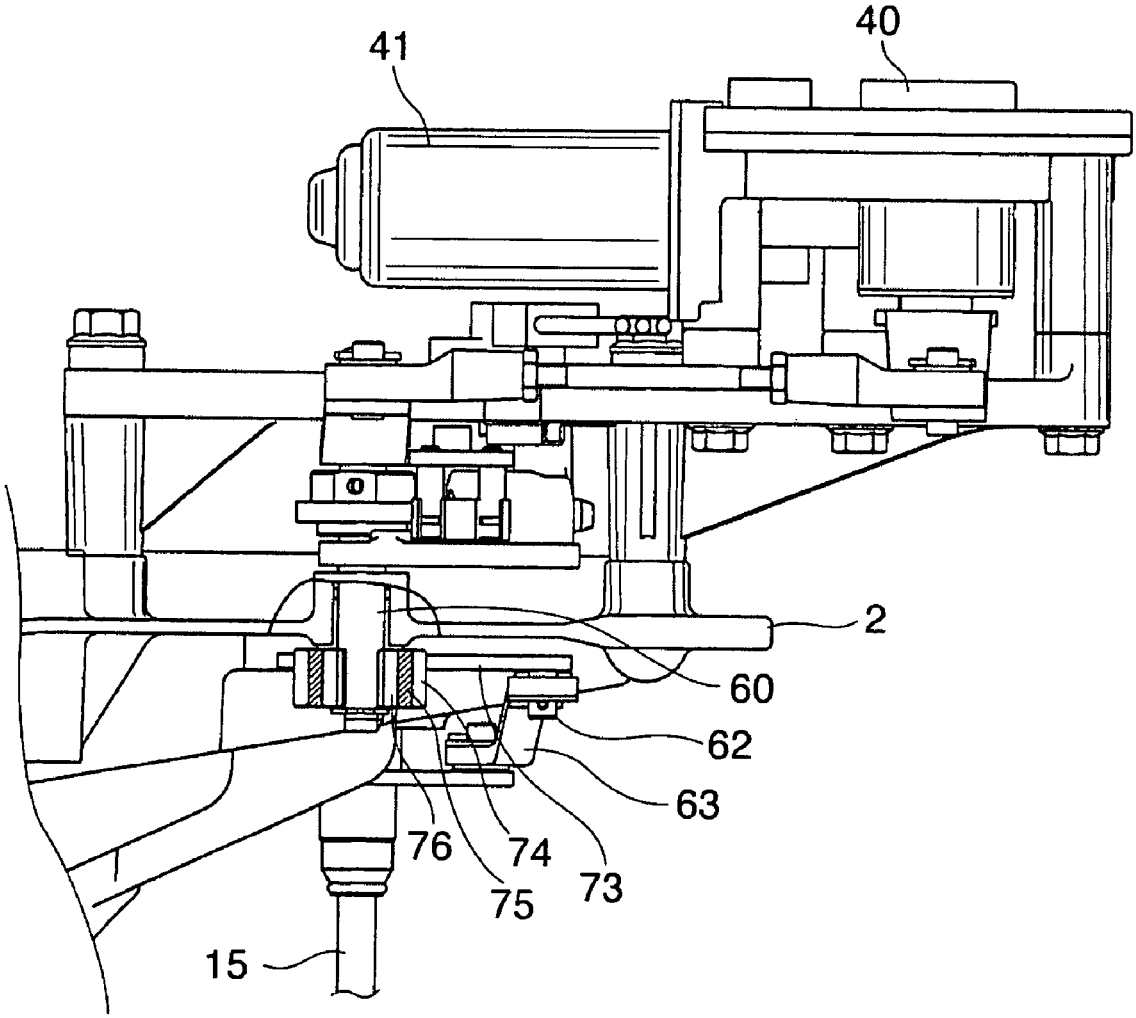
FIG. 13 is a right side view corresponding to FIG. 5 but showing a third example of application of a damper to the shift system according to the second embodiment.

FIG. 13 is a right side view corresponding to FIG. 5 but showing a third example of application of a damper to the shift system according to the second embodiment. In this example, a damper 75 is provided between the lower end of the clutch shaft 60 and the right end of the second link member 63.

An annular inner spacer 76 is connected to the lower end of the clutch shaft 60 in a manner rotatable in unison with the clutch shaft 60. Annular damper 75 is fixed to the outer periphery of the inner space 76 e.g. by bonding. An arm 73 corresponding to the arm 61 has one end thereof integrally formed with an annular spacer part 74, and the inner peripheral surface of the spacer part 74 is fixed to the outer periphery of the damper 75 e.g. by bonding. The other end of the arm 73 is connected to the right end of the second link member 63 such that the arm 73 is pivotally movable about the connecting pin 62 as a pivot.

This variation makes it possible to provide a damping or cushioning function in a torsional direction between the clutch shaft 60 and the arm 73, thereby providing the same advantageous effect as provided in the first example of application of the damper.

Figure 14:
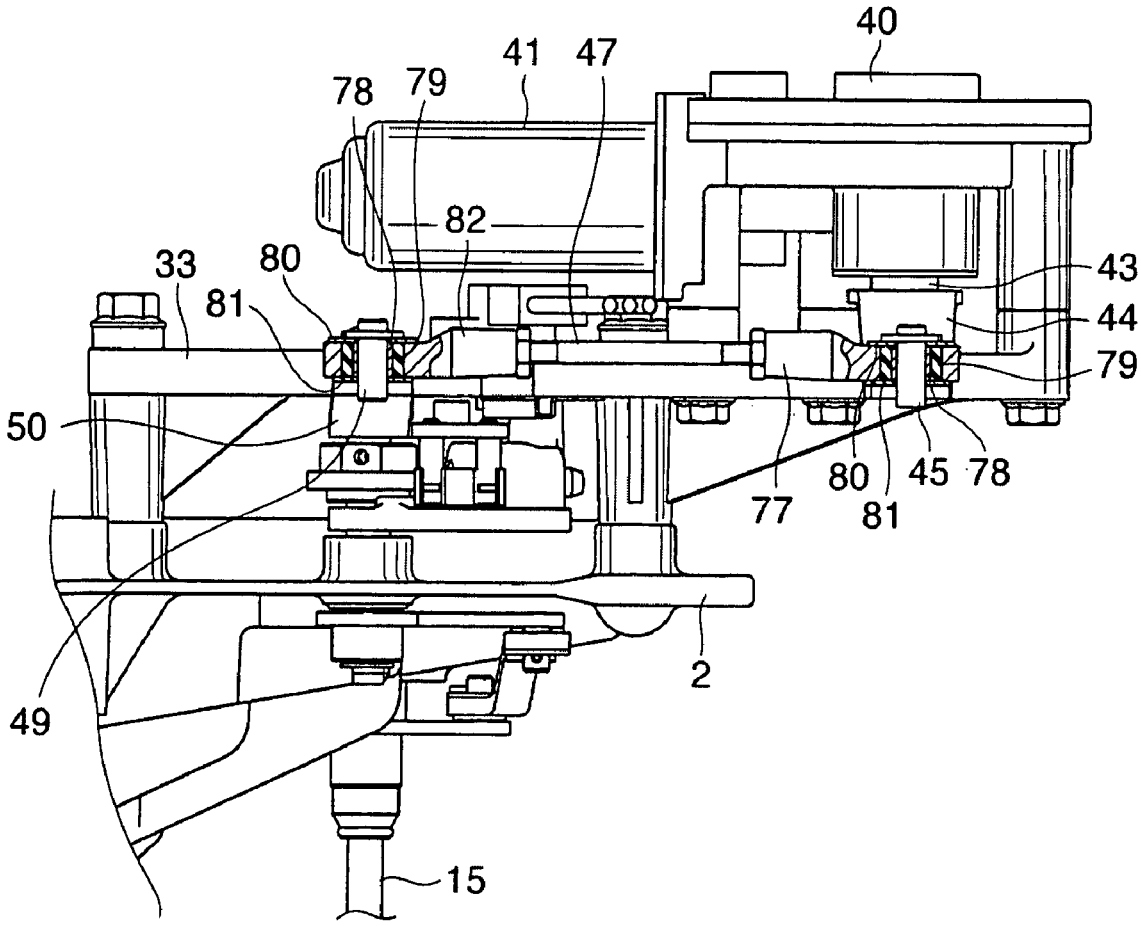
FIG. 14 is a right side view corresponding to FIG. 5 but showing a fourth example of application of a damper to the shift system according to the second embodiment.

FIG. 14 is a right side view corresponding to FIG. 5 but showing a fourth example of application of the damper to the shift system according to the second embodiment. In this example, dampers 79 are provided between the actuator output shaft 43 and the first link member 47 and between the first link member 47 and the clutch shaft 60, respectively.

A connector 77 corresponding to the connector 46 is attached to the front end of the first link member 47, and a connector 82 corresponding to the connector 48 is attached to the rear end of the first link member 47. An annular spacer 78 and an annular damper 79 are fitted on the outer periphery of the connecting pin 45 pivotally connecting between the other end of the arm 44 and the connector 77. Washers 80 and 81 as stoppers are mounted above and below the spacer 78 and the damper 79, respectively. A juncture between the connector 82 and the arm 50 has the same arrangement.

This variable makes it possible to provide a damping or cushioning function between the first link member 47 and the arms 44 and 50, thereby providing the same advantageous effect as provided in the first example of application of the damper.

Figure 15:
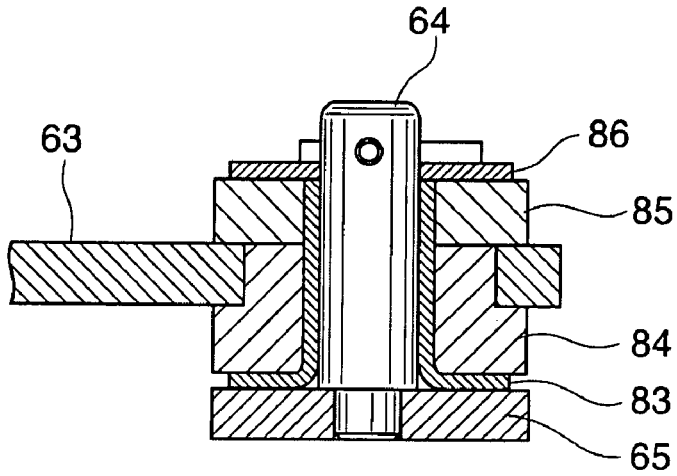
FIG. 15 is a cross-sectional view of a juncture between a second link member and an arm, which shows a fifth example of application of a damper to the shift system according to the second embodiment.

FIG. 15 is a cross-sectional view of a juncture between a second link member 63 and an arm 75, which shows a fifth example of application of a damper to the shift system according to the second embodiment. On the left end of the second link member 63, a lower damper 84 and an upper damper 85 are fitted on the connecting pin 64 via a spacer 83, and a washer 86 is provided on the upper side of the upper damper 85. Although not shown, the same arrangement as this is applied to a juncture between the right end of the second link member 63 and the arm 61.

This variation makes it possible to provide a damping or cushioning function between the second link member 63 and the arms 65 and 61, thereby providing the same advantageous effect as provided in the first example of application of the damper.

It should be noted that in the present embodiment, a damper may be provided at any location between the first linkage and the upper end of the clutch rod 15 insofar as impact caused by the operation of the actuator ACT can be buffered, and hence the location of the damper is not limited to the above-described locations.

Further, two or more of the first to fifth examples of application of the damper may be used simultaneously. This provision of dampers at a plurality of locations, it is possible to obtain high damping effects with the compact arrangement.

Next, a third embodiment of the present invention will be described with reference to FIGS. 16A to 18. In the first embodiment, the neutral switch 52 and the position sensor 51 are arranged in a concentrated manner in the vicinity of the actuator ACT above the engine holder 2 to thereby save space. However, from the viewpoint of securing the function of detecting the operation of the shift system, the position sensor 51 may be positioned at any location where the operation detection can be performed, and hence the location of the position sensor 51 is not limited to a location beside the clutch shaft 60. The third embodiment is identical in arrangement to the first embodiment except for the location of the position sensor 51. In FIGS. 16A to 18, component parts and elements which are identical to those of the first embodiment are designated by identical reference numerals.

Figure 16A:
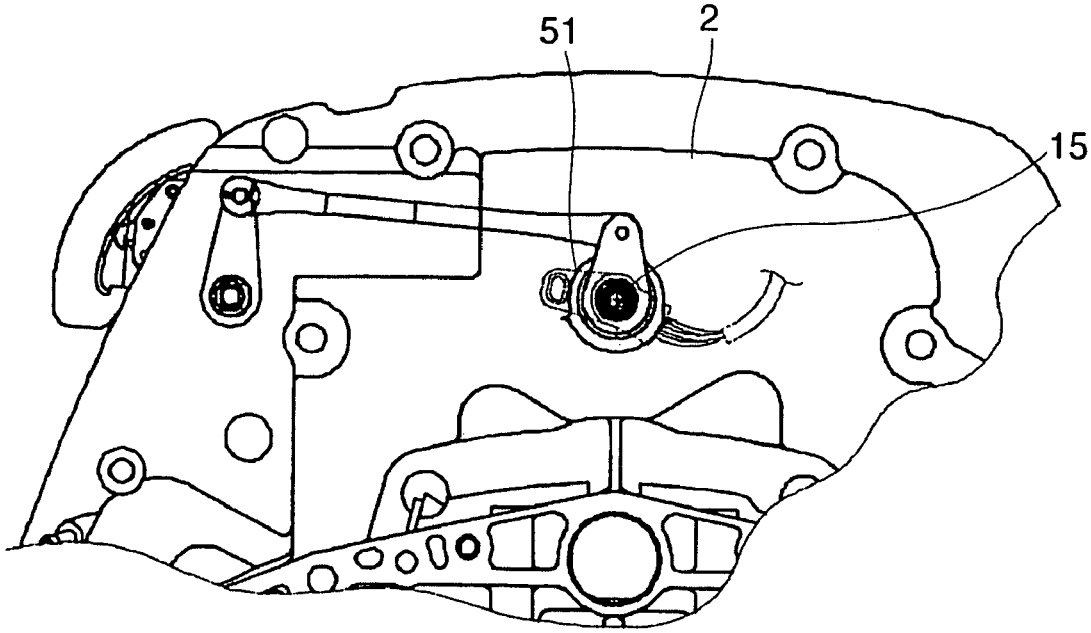
Figure 16B:
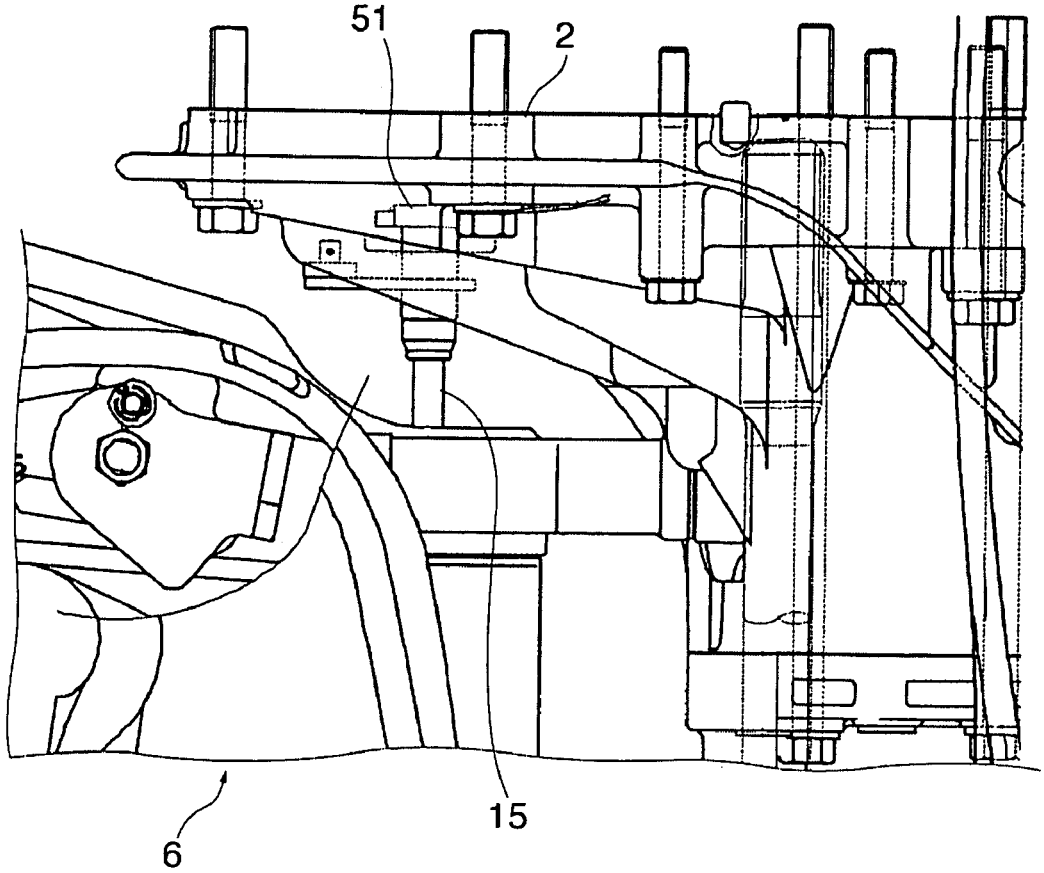

FIG. 16A is a bottom view of a right front part of an engine holder in the shift system according to the third embodiment, which corresponds to FIG. 4, and FIG. 16B is a cross-sectional view of the upper front part of the engine holder.

In this example, as shown in FIGS. 16A and 16B, the position sensor 51 is disposed on the upper end of the clutch rod 15 and fixed to the engine holder 2. The position sensor 51 is disposed coaxially with the clutch rod 15, and is configured to detect the rotational angle of the clutch rod 15 in place of the rotational angle of the clutch shaft 60. It should be noted that the position sensor 51 may not be disposed coaxially with the clutch rod 15, but it may be configured and disposed such that the rotational angle of the clutch rod 15 can be detected via a gear or the like.

Figure 17:
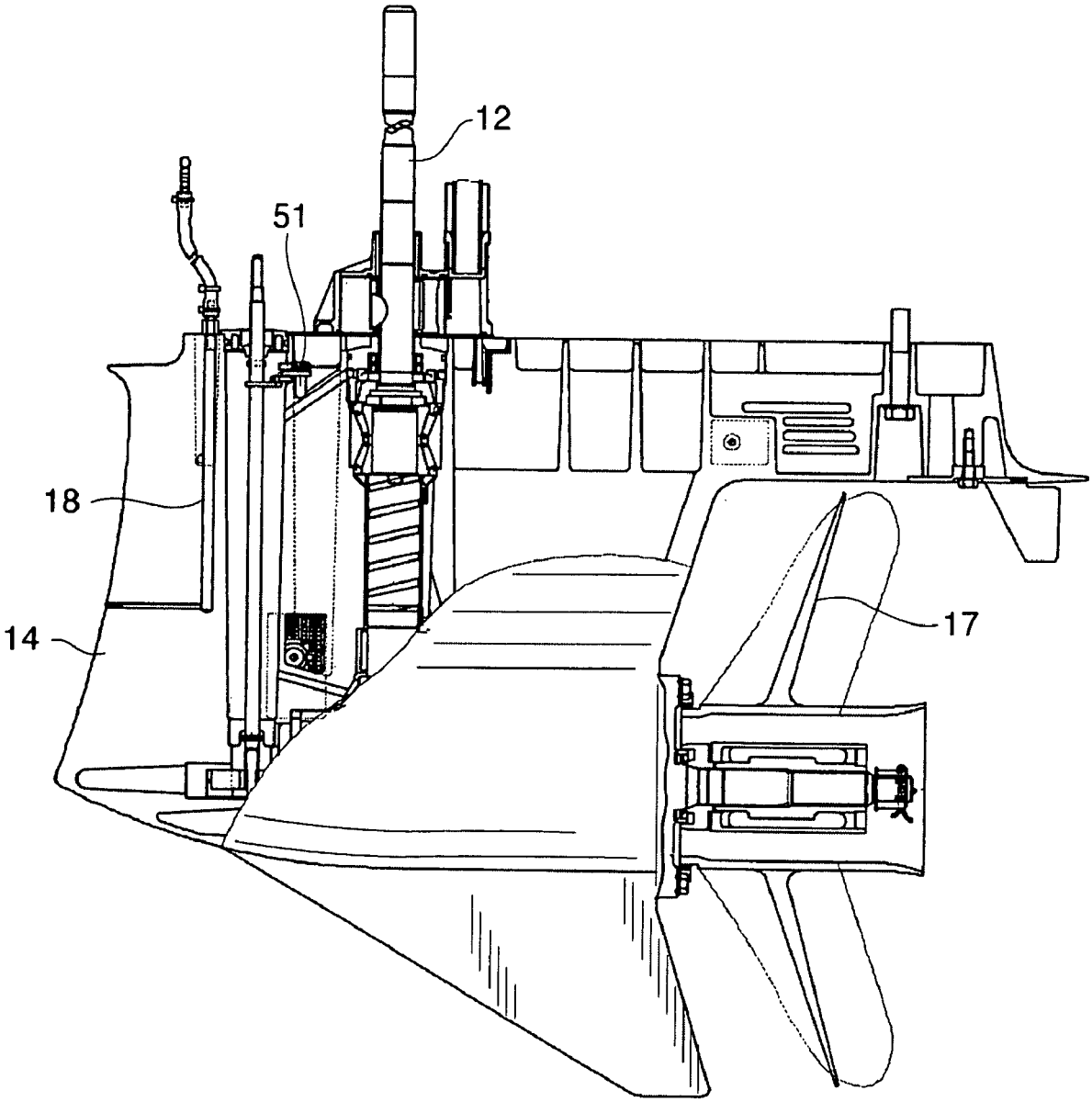
FIG. 17 is a cross-sectional view of a front part of a gear case, which shows a second example of disposition of a position sensor in the shift system according to the third embodiment.
Figure 18:
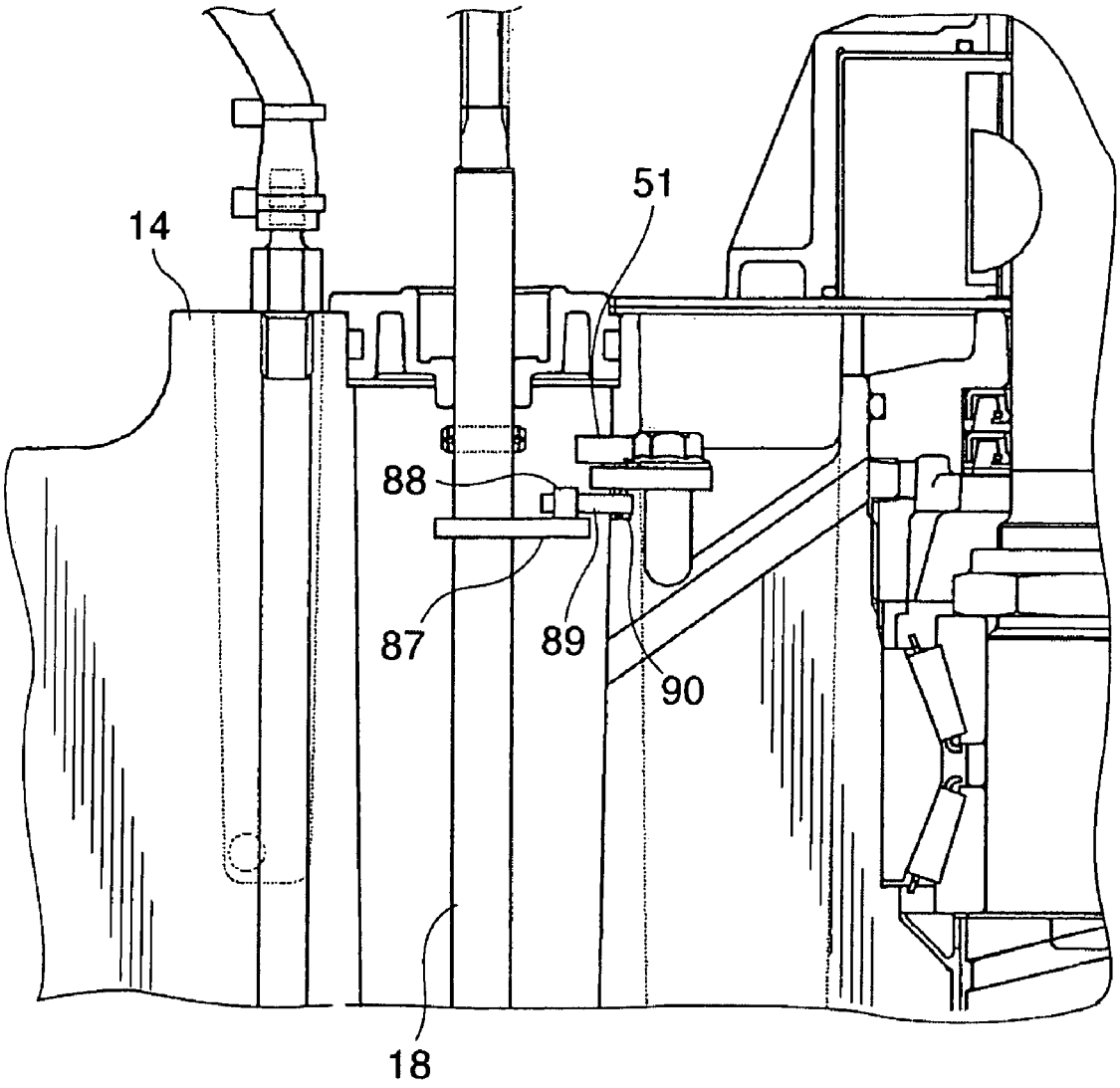
FIG. 18 is an enlarged fragmentary view of FIG. 17.

FIG. 17 is a cross-sectional view of the front part of the gear case 14, which shows a second example of disposition of a position sensor in the shift system according to the third embodiment. FIG. 18 is an enlarged fragmentary view of FIG. 17.

In this example, the position sensor 51 is fixedly disposed in the gear case 14, as shown in FIGS. 17 and 18. As shown in FIG. 18, an arm 87 is fixed to the shift rod 18, and a connecting pin 88 is formed on a free end of the arm 87. A pin 90 is formed on the position sensor 51, and the connecting pin 88 and the pin 90 are linked to each other by a link member 89. The position sensor 51 is configured to detect the rotational angle of the shift rod 18 indirectly in place of the rotational angle of the clutch shaft 60. It should be noted that the position sensor 51 may be configured and disposed such that the rotational angle of the shift rod 18 can be detected not via the linkage, but via a gear or the like.

Figure 19A:
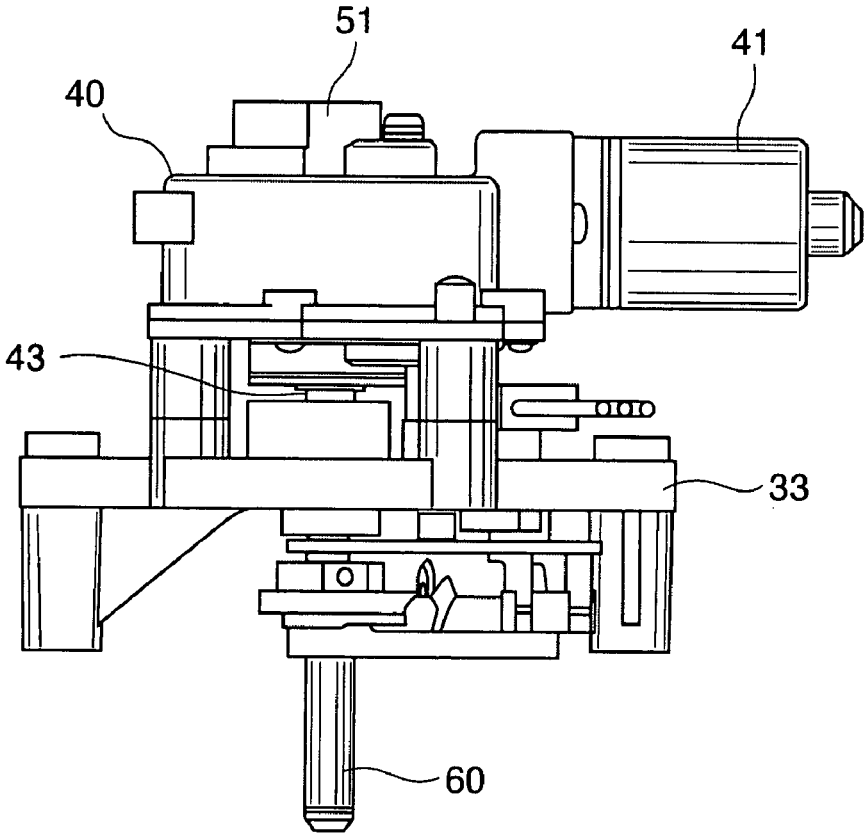
FIG. 19A is a side view of essential parts of a shift system according to a fourth embodiment of the present invention.
Figure 19B:
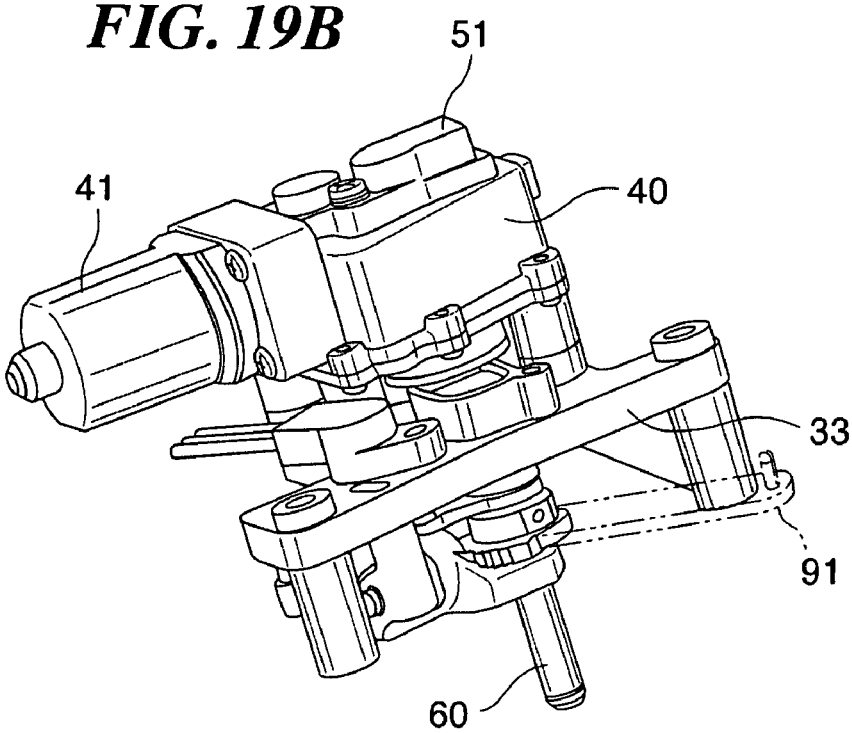
FIG. 19B is a perspective view of the essential parts of the shift system according to the fourth embodiment.

FIG. 19A is a side view of an essential part of a shift system according to a fourth embodiment of the present invention, and FIG. 19B is a perspective view of the same.

In the first embodiment, the actuator output shaft 43 and the clutch shaft 60 are connected to each other by the first linkage. However, from the viewpoint of making the construction of the shift system simple and compact, the first linkage may be dispensed with as shown in FIGS. 19A and 19B, and the actuator output shaft 43 and the clutch shaft 60 may be coaxially directly connected to each other.

Further, in this arrangement, a lever 91 for manual operation is fixedly attached to the upper end of the clutch shaft 60, as shown in FIG. 19B, so as to secure the failsafe function as well. This makes it possible to manually operate the lever 91 to drive the clutch shaft 60 in the event of failure of the actuator ACT, thereby enabling manual shift operation.

In the present embodiment, the position sensor 51 is disposed on the top of the actuator body 40, for detecting the rotational angle of the actuator output shaft 43.

It should be noted that the manner of disposition of the position sensor 51 in the present embodiment can be added to the examples of disposition of the position sensor 51 in the third embodiment.

While the present invention has been described with reference to exemplary embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2006-125691, filed Apr. 28, 2006 which is hereby incorporated by reference herein in its entirety.

What is claimed is:

1. A shift system for an outboard motor, which detects a vessel operator's shift operation and performs a shift operation for the outboard motor in a motor-driven manner in response to the detected vessel operator's shift operation, comprising:

a motor-driven shift actuator disposed at a location forward of and lateral to an engine within an engine cover covering the engine;

an electric motor provided for said motor-driven shift actuator and disposed at a location rearward of said motor-driven shift actuator, said electric motor having a motor output shaft disposed in a manner extending forward, and being operated in response to the detected vessel operator's shift operation;

an actuator output shaft disposed at a location forward of said electric motor and extending downward from a front part of said motor-driven shift actuator, and rotating in accordance with rotation of said motor output shaft;

a clutch shaft disposed below said motor-driven shift actuator and rearward of said actuator output shaft; and a first linkage disposed on a side of said motor-driven shift actuator, as viewed in plan view, and connecting between said actuator output shaft and said clutch shaft.

2. A shift system as claimed in claim 1, wherein said motor-driven shift actuator is mounted on an upper side of a base member secured to the outboard motor, said clutch shaft extending downward from the base member, and wherein a neutral switch is disposed under the base member and beside said clutch shaft.

3. A shift system as claimed in claim 1, wherein said motor-driven shift actuator is mounted on an upper side of a base member secure to the outboard motor, said clutch shaft extending downward from the base member, and wherein a position sensor is disposed on the upper side of the base member and below said electric motor, for detecting a rotational angle of said clutch shaft.

4. A shift system as claimed in claim 1, further comprising a clutch rod connected to a clutch mechanism within a gear case of the outboard motor, and a second linkage connecting between said clutch shaft and said clutch rod, and wherein a damper is provided on at least one portion of said first linkage, said second linkage, and an upper end of said clutch rod.

5. A shift system as claimed in claim 1, wherein the engine cover can be vertically divided at a dividing face, and wherein said motor-driven shift actuator is disposed above the dividing face while said first linkage is disposed below the dividing face.

* * * * *